US010368152B2

(12) United States Patent
Christiansen et al.

(10) Patent No.: US 10,368,152 B2
(45) Date of Patent: Jul. 30, 2019

(54) MICROPHONE ARRANGEMENT

(71) Applicant: Sennheiser Communications A/S, Ballerup (DK)

(72) Inventors: Torben Christiansen, Ballerup (DK); Svend Feldt, Ballerup (DK); Kim Larsen, Ballerup (DK)

(73) Assignee: SENNHEISER COMMUNICATIONS A/S, Ballerup (DK)

( * ) Notice: Subject to any disclaimer, the term of this patent is extended or adjusted under 35 U.S.C. 154(b) by 0 days.

(21) Appl. No.: 15/712,512

(22) Filed: Sep. 22, 2017

(65) Prior Publication Data

US 2018/0091882 A1 Mar. 29, 2018

(30) Foreign Application Priority Data

Sep. 23, 2016 (EP) ..... 16190335

(51) Int. Cl.
*H04R 1/08* (2006.01)
*H04R 1/10* (2006.01)
(Continued)

(52) U.S. Cl.
CPC ..... *H04R 1/083* (2013.01); *H04R 1/1083* (2013.01); *H04R 1/406* (2013.01); *H04R 3/005* (2013.01);
(Continued)

(58) Field of Classification Search
CPC ..... H04R 1/1091; H04R 2460/13; H04R 2201/107; H04R 3/005; H04R 1/083; H04R 1/406
See application file for complete search history.

(56) References Cited

U.S. PATENT DOCUMENTS 9,288,562 B2 3/2016 Andersen et al.
2010/0296668 A1* 11/2010 Lee ..... G10K 11/178 381/94.7
(Continued)

FOREIGN PATENT DOCUMENTS

EP 2 744 221 A1 6/2014

*Primary Examiner* — Sunita Joshi
(74) *Attorney, Agent, or Firm* — Birch, Stewart, Kolasch & Birch, LLP

(57) ABSTRACT

The disclosure relates to a microphone arrangement comprising at least three groups of microphones that are mounted on a head-wearable support structure. The at least three groups of microphones comprising a first group of microphones with one or more microphones, a second group of microphones with one or more microphones, and a third group of microphones with one or more microphones, wherein the first group is mounted to a casing that accommodates signal transmission circuitry, the second group is mounted to slide with respect to the casing and the first group is mounted in a direction of a first axis. Furthermore, the third group comprises either at least one microphone that is arranged on the support structure so as to exhibit less sensitivity for sound coming from a user's mouth than for sound coming from a user's environment when the microphone arrangement is head-worn; or at least two microphones that are arranged symmetrically with respect to a user's head when the microphone arrangement is head-worn and that provide for a directionality that is orientated to the direction of a user's vision; or both.

18 Claims, 6 Drawing Sheets

(51) Int. Cl.
*H04R 1/40* (2006.01)
*H04R 3/00* (2006.01)

(52) U.S. Cl.
CPC ..... *H04R 1/1008* (2013.01); *H04R 1/1041* (2013.01); *H04R 2201/107* (2013.01); *H04R 2201/403* (2013.01)

(56) References Cited

U.S. PATENT DOCUMENTS

| | | | | |
|---|---|---|---|---|
| 2014/0003613 | A1 | 1/2014 | Sibbald | |
| 2015/0003623 | A1* | 1/2015 | Rasmussen ..... | G10K 11/002 381/71.6 |
| 2015/0304749 | A1* | 10/2015 | Andersen ..... | H04R 1/083 381/362 |

* cited by examiner

MICROPHONE ARRANGEMENT

TECHNICAL FIELD

The disclosure relates to a microphone arrangement. Furthermore, the disclosure relates to a microphone arrangement system, to a microphone boom and to a headset.

BACKGROUND

Microphone arrangements having an array of microphones for obtaining a directional signal are known. Such microphone arrangements must comply with certain measures regarding spacing of the microphones in case improved directional characteristics are desired. An arrangement with good storage capability is desired, which also maximize the effect of the number of microphones used for the arrangement. In headsets it is known to provide a boom arm with two or more microphones, such that the microphones provide an array pointed towards the mouth of the user, with the view to derive a direc-tional signal by combining the signals from the microphones in a predefined manner. It is also known to provide a microphone on a movable boom arm, whereby movement of the boom arm will control on/off function of the headset. A headset with good storage capability is desired, wherein maximum effect of the microphone array is obtained at the same time.

EP 2 744 221 describes a microphone boom that comprises a first group of micro-phones with two or more microphones fixated along a first axis and a second group of microphones fixated along a second axis. The first group and the second group of microphones are movably mounted with respect to each other. This allows the two arrays to be collapsed with respect to each other, when the boom is not in use and needs to be stored.

U.S. Pat. No. 9,288,562 B2 further describes a headset having a microphone boom with extendable microphone arrays. The headset comprises a casing accommodating the signal trans-mission circuitry and further comprises a speaker adapted to serve a sound signal in the proximity of a user's ear and the speaker is protruding from the casing at a speaker-end of the casing and a microphone assembly is fixated relative to the casing distally with respect to the speaker-end.

SUMMARY

An object of the present disclosure is to provide an improved microphone arrangement.

According to a first aspect, the disclosure relates to a microphone arrangement comprising at least three groups of microphones that may be mounted on a head-wearable support structure. The at least three groups of microphones comprising a first group of microphones with one or more microphones, a second group of microphones with one or more microphones, and a third group of microphones with one or more microphones, wherein the first group may be mounted to a casing that accommodates signal transmission circuitry, the second group is mounted to slide with respect to the casing and the first group may be mounted in a direction of a first axis, and the third group comprises;

- either at least one microphone that may be arranged on the support structure so as to exhibit less sensitivity for sound coming from a user's mouth than for sound coming from a user's environment when the microphone arrangement is head-worn,
- or at least two microphones that may be arranged symmetrically with respect to a user's head when the microphone arrangement is head-worn and that provide for a directionality that is orientated to the direction of a user's vision
- or both.

The microphone arrangement according to the first aspect of the disclosure can advantageously receive signals from an environment of the microphone arrangement. This allows an advanced noise reduction by means of the third group of microphones.

In case that the third group is arranged as to exhibit less sensitivity for sound coming from a user's mouth, the third group can provide a noise estimate that is more robust and has a better signal-to-noise ratio (SNR) than a noise estimate that is based on signals received by the first or second group of microphones alone.

By sliding the second group with respect to the casing, a directionality of the sound signal provided by the first and second group of microphones is provided, which is improved until the first and second groups have reached the largest distance from each other. Using the third group in combination with the advantageous arrangement of the first and second groups leads to the particular advantage that the noise within the directional signals can be reduced even further by providing a further noise reduction with respect to signals received by the third group. Thus, the microphone arrangement provides an enhanced directionality with an improved signal-to-noise ratio. This further allows an expansion of a speech frequency range provided by the microphone arrangement, since typically loud noise within the low frequency range can be filtered reliably and respective low frequency signal parts of a target speech of the user can be provided. The noise reduction might be provided by subtracting a signal received by the third group of microphones from the signals received by the first and second groups.

In case that the third group comprises at least two microphones arranged symmetrically with respect to a user's head and provide for a directionality that is orientated to the direction of a user's vision, the third group improves noise filtering of uncorrelated noise, such as wind noise. By being provided at different ends of the head-wearable support structure, i.e. at different sides of the user's head and facing away from the user's mouth, the microphones of the third group can improve a detection of an acoustic signal provided by the user's mouth via the first and the second group of microphones.

The first and the second group of microphones can be spatially separated from each other. They can also be in close proximity for at least one sliding position of the second group of microphones.

Microphones that belong to a single group of microphones can be arranged in close proximity to each other or spatially separated. Especially microphones of the third group of microphones might be arranged at different ends of the head-wearable support structure.

If nothing else is specified, the term "group" is to be understood in this specification as comprising one, two or more items.

In the following, the microphone arrangement according to the first aspect will be described.

The first and/or the second group of microphones comprises at least two microphones that are arranged along said first axis or along an axis running parallel to said first axis. Using more than one microphone further improves the directionality of the signal provided by the first and/or second group. In general, a voice signal which is captured by an array of microphones from the most sensitive direction will gain in understandability with every added microphone element, and moving from an array of two microphones which is known in headsets to three microphones will add up to 10% to the ratio of a speech signal which the far end user of a headset system will be able to understand. In terms of free field directionality index this amount to an increase of 3 dB when going from an array of two microphones to an array of three microphones.

The third group of microphones comprises at least two microphones that may be arranged along a second axis, which is different from the first axis.

Using a common axis for microphones of one group of microphones allows the respective group to be arranged such that the microphones of this group will form a single combined array with optimal distance between the microphones, and thereby enhance the directionality effect.

At least one microphone of said third group of microphones may be mounted to said casing. This allows a very compact and robust structure of the microphone arrangement.

Furthermore, a noise reduction using signals received by the third group of microphones is more effective in this embodiment, since the noise received by the third group has the same noise level and spectral structure than the noise received by the closely arranged microphones of the first and second group.

The microphone arrangement according to the first aspect of the disclosure the casing is formed by a first ear pad to be worn next to a user's first ear and the first group and the third group of microphones are attached to the first ear pad. In a variant, there is a speaker unit arranged at the casing, enabling a user of the microphone arrangement to communicate via the devices arranged at the head-wearable support structure, which for instance forms a headset.

The casing may be formed by a first ear pad. Furthermore, the third group may be at least partly attached to a second ear pad of the head-wearable support structure to be worn next to a user's second ear. In a preferred variant, at least one microphone of the third group may be attached to the first ear pad. Thereby, at least two microphones are arranged at opposite sides of the user's head allowing an improved detection of speech of the user.

Preferably, the at least one microphone of the third group of microphones may be arranged such that, upon use of the microphone arrangement by a user, a distance between the at least one microphone and the mouth of the user of the microphone arrangement is larger than a distance between a microphone of the first or second group of microphones and the mouth of the user. The microphone arrangement is particularly advantageous, since signals received in proximity to the mouth of the user are particularly suitable for receiving and processing the user's voice, while a microphone that is not proximate to the user's mouth can be advantageously used to detect noise signals of the environment of the microphone arrangement. In a preferred variant of this embodiment, the at least one microphone of the third group is directed away from the mouth of the user. In a further variant, at least two microphones of the third group of microphones that are arranged symmetrically with respect to a user's head are directed towards the mouth of the user.

The third group may comprise a number of microphones directed away from the mouth of the user, while a further number of microphones of the third group are arranged symmetrically with respect to the user's head and directed towards the mouth of the user. Thus, the number of microphones does beamforming towards the mouth of the user, while the further number of microphones does anti-beamforming towards the user's mouth.

Preferably, signals received with microphones of the number of microphones are processed differently than signals received with microphones of the further number of microphones. This is realized in a variant of this embodiment by providing two separate processing units for respective microphones of the third group.

The microphone arrangement according to the first aspect of the disclosure, the second group of microphones may be mounted on a slider that is arranged to slide on a corresponding rail of the slider between a closed position and an opened position, wherein the rail may be arranged on the casing. Typically, the closed position is a position of non-use while the opened position is a position with the first group spaced apart from the microphones of the second group, and therefore a position of use, which particularly enhances a directionality of a signal provided by the microphone arrangement. In this embodiment, the first and second group of microphones may be allowed to be collapsed with respect to each other, when the microphone arrangement is not in use and needs to be stored. In this way, major directional characteristics may be obtained while the microphone arrangement remains easy to store.

Preferable, the slider is a U-shaped slider. This allows a particular advantageous compactness and robustness, as for example described in EP 2 744 221. In a further advantageous variant, the slider is provided to slide along a common axis defined by the arrangement of the microphones of the second group, forming that common axis. In a further variant the first group and the second group of microphones define a combined directional array of microphones when the slider is in the opened position.

The first group, the second group and the third group may be connected to the signal transmission circuitry. By using a single signal transmission circuitry, the microphone arrangement of this embodiment provides a particularly compact design and a fast processing of the sound signal received by the groups of microphones.

The third group and/or the first group of microphones may be arranged and configured to be formed by a bone conductor or by a necklace microphone array. The third group and/or the first group of this embodiment may be arranged in a fixed position that might not easily slip out of position as it is the case for a headset.

The third group may be provided in a headband or in a neckband of the microphone arrangement. The third group of microphones of this embodiment can be arranged to form a large microphone array compared to microphones that are mounted to an ear pad.

According to a second aspect, the disclosure relates to a microphone arrangement system, comprising the microphone arrangement according to the first aspect of the disclosure. The microphone arrangement system further comprises a processing unit which is arranged to be connected to the signal transmission circuitry and configured to process sound signals received by the first and second group with a noise filter that is adapted with respect to a noise signal received by the third group of microphones.

The noise filter may be configured to subtract sound signals received from the third group of microphones from the preferably directional signal provided by the first and second group of microphones in response to the respective sound signal received by the first and second group of microphones.

The microphone arrangement further comprises a noise estimator connected to the signal transmission circuitry, wherein the noise estimator may be configured to estimate a noise level of the environment of the microphone arrangement system and to control the noise filter with respect to the estimated noise level. In a variant of this embodiment, the noise estimator is further configured to estimate a noise spectrum of the environment and to further control the noise filter with respect to the estimated noise spectrum. In a further variant, the noise filter may be controlled in a way that the noise filter is deactivated if the estimated noise level is below a predefined threshold and that the noise filter is activated, if the estimated noise level is above the predefined threshold. The noise estimator of this embodiment is build according to well known noise estimators that are used in the field of hearing devices. Preferably, the noise estimator receives a noise signal for estimating the noise level and/or the noise spectrum via an electrical connection with the third group of microphones.

The processing unit may be configured to process a signal according to a sliding position of the second group of microphones with respect to the first group. In a variant, the processing unit may be deactivated or configured not to process a signal, if the sliding position of the second group is a closed position, while the processing unit processes a signal if the sliding position of the second group is an opened position.

In a further variant, the microphones of the first group, of the second group and of the third group of microphones may be arranged and configured to be deactivated, if the sliding position of the second group is the closed position.

According to a third aspect, the disclosure relates to a microphone boom, which may be arranged and configured for being used in the microphone arrangement according to the first aspect of the disclosure or the microphone arrangement system according to the second aspect of the disclosure.

Preferable, one end of the microphone boom may be directed to the mouth of the user. The first and/or the second group of microphones may be arranged at this end of the microphone boom and thereby directed to the mouth of the user. The third group of microphones may be at least partly arranged at an opposite end of the microphone boom and thereby directed away from the user's mouth.

In a preferred variant, the microphone boom comprises the microphone arrangement according to the first aspect of the disclosure.

The microphone boom comprises the slider, preferably an U-shaped slider, at the end directed to the mouth. In this embodiment, the slider with the second group of microphones can be slid into the opened position that is formed such that the microphones of the second group are closer to the mouth of the user than it is the case in the closed position of the slider.

According to a fourth aspect, the disclosure relates to a headset, comprising the microphone arrangement system according to the second aspect of the disclosure or the microphone boom according to the third aspect of the disclosure.

The headset of this aspect is a preferred implementation of the microphone arrangement according to the first aspect of the disclosure. This embodiment is particularly advantages, since other devices can be combined with the microphone arrangement in a very compact way, such as a speaker unit arranged in an ear pad of the headset and/or an antenna unit attached to the ear pad and configured to allow wireless communication with a further communication device.

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure.

Figure 1:
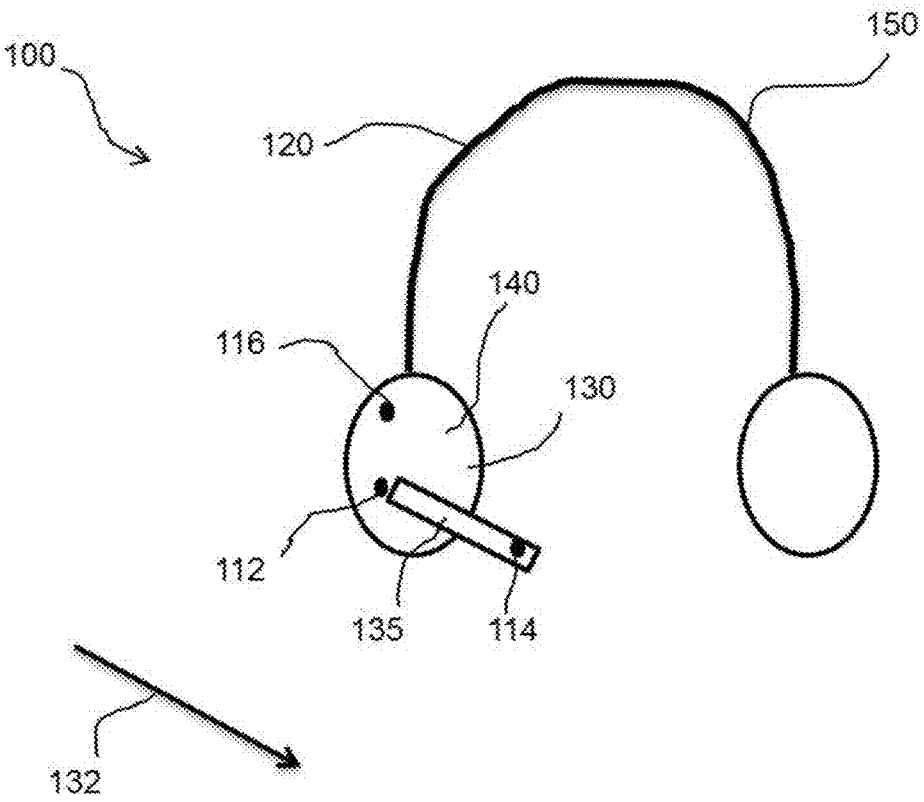
FIG. 1 illustrates a first embodiment of a microphone arrangement according to a first aspect of the disclosure.

Now referring to FIG. 1, which illustrates a first embodiment of a microphone arrangement 100 according to a first aspect of the disclosure. A vision of a user of the microphone arrangement 100 is directed out of the drawing plane.

The microphone arrangement 100 comprises at least three groups of microphones 112, 114, 116 that are mounted on a head-wearable support structure 120. The first group of microphones 112 comprises two microphones, the second group of microphones 114 comprises two microphones, and the third group of microphones 116 comprises a single microphone. For reasons of clarity, the microphones are not shown in FIGS. 1 to 3, but discussed in detail in the course of FIG. 6. The first group of microphones 112 is mounted to a casing 130 that accommodates signal transmission circuitry (shown in FIG. 6) and thereby mounted in a direction of a first axis 132. The second group of microphones 114 is mounted to slide along a microphone boom 135 with respect to the casing 130. The microphones of the second group of microphones 114 are arranged along an axis running parallel to the first axis. The third group 116 comprises one microphone that is arranged on the support structure 120 so as to exhibit less sensitivity for sound coming from a user's mouth than for sound coming from a user's environment when the microphone arrangement 100 is head-worn.

The microphones of the first, second and third group 112, 114, 116 are all mounted at an ear pad 140 of a headset 150, wherein the ear pad 140 is formed by the casing 130.

In case of use, the microphones of the second group 114 are the nearest microphone at the user's mouth. They receive a sound signal and provide a corresponding first signal. The microphones of the first group 112 receive the sound signal from a further location and provide a respective second signal. The first and second signals are used to provide a directional signal. This directional signal passes a noise filter (shown in FIG. 6) that subtracts a third signal provided by the microphones of the third group of microphones 116. The third group of microphones 116 has the largest distance to the mouth of the user and is directed away from this mouth. Therefore, the microphones of the third group of microphones 116 mainly receive noise signals from the user's environment, which are also comprised by the first and second signal and can therefore by advantageously removed from these signals.

All microphones of the microphone arrangement 100 are connected to the microphone circuitry.

Figure 5:
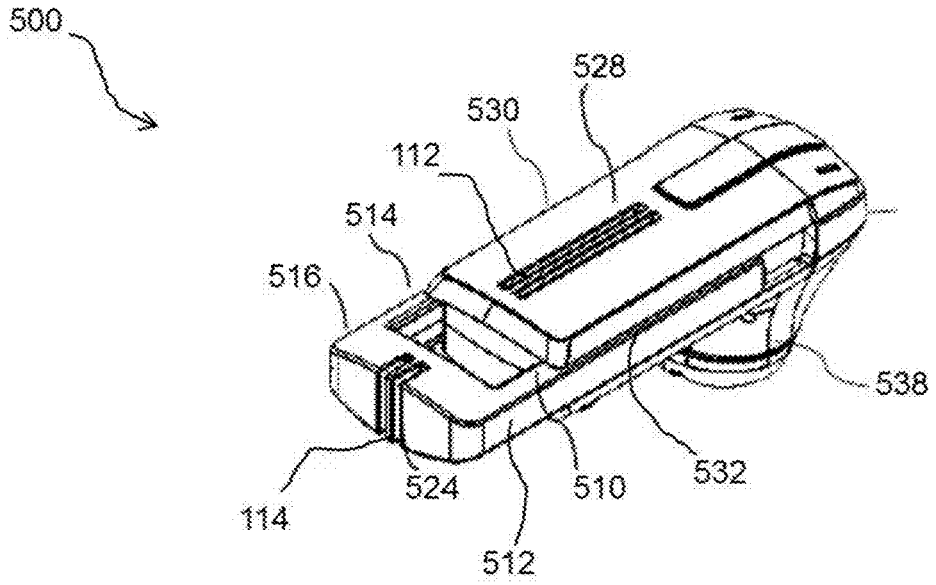
FIG. 5 illustrates an embodiment of a microphone boom according to a third aspect of the disclosure.

The microphone boom 135 comprises a sliding mechanism for sliding the microphones of the second group 114 with respect to the casing 130. A detailed illustration of an embodiment of the structure of this sliding mechanism is shown in FIG. 5.

For reasons of clarity, it is not shown in the following figures, that the respective headset 150 further comprises speaker units mounted at the ear pads 140 of the head set 150, in order to provide an audible sound signal to the user's ears. Thus, it should be clear that all embodiments of microphone arrangements discussed in the following are preferably combined with further well known features of headsets, such as for instance the signal transmission circuitry used in headsets.

In embodiments not shown, the third group and/or the first group of microphones is arranged and configured to be formed by a bone conductor or by a necklace microphone array or by a further structure that allows a fixed position of the third and/or first group of microphones in proximity to the head of the user.

In further embodiments not shown, the third group is provided in a headband or in a neckband of the microphone arrangement.

Figure 2:
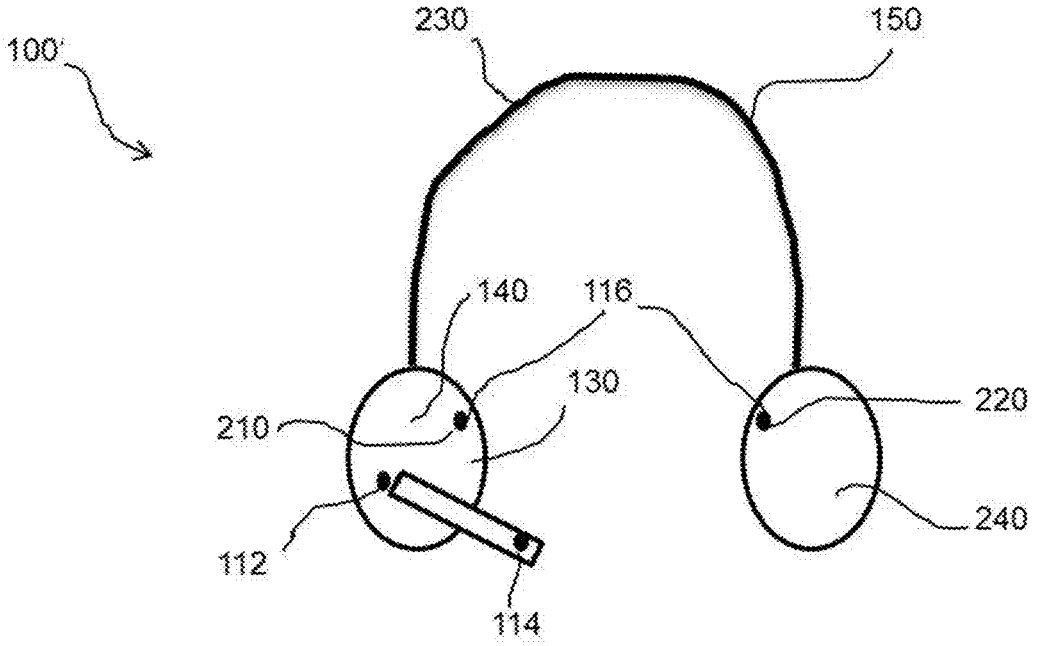
FIG. 2 illustrates a second embodiment of the microphone arrangement according to the first aspect of the disclosure.
Figure 3:
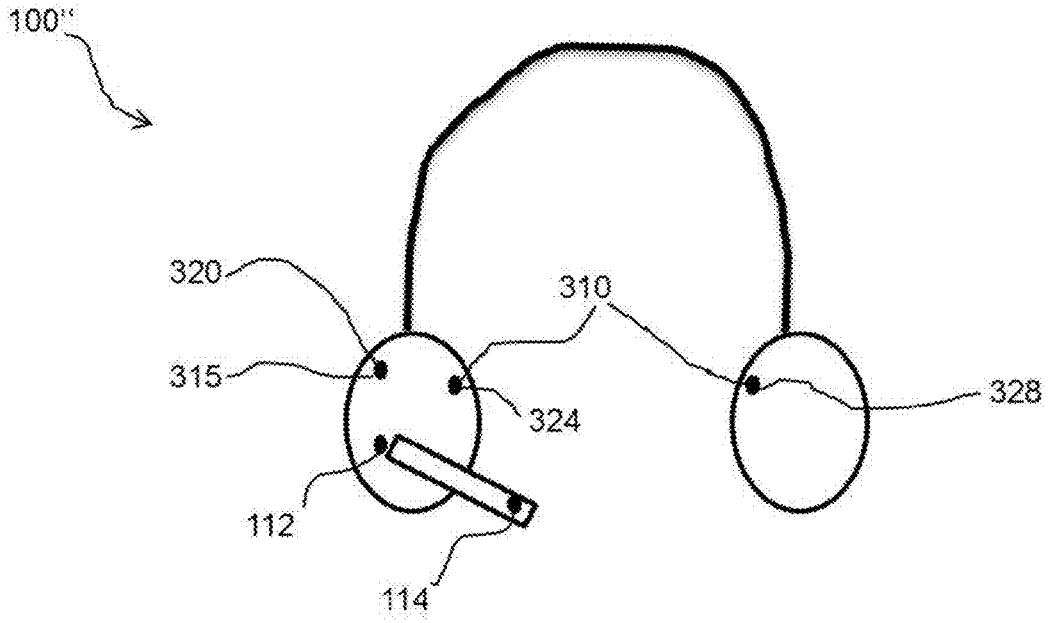
FIG. 3 illustrates a third embodiment of the microphone arrangement according to the first aspect of the disclosure.

In a further embodiment, the third group comprises a plurality of microphones (see FIGS. 2 and 3). Further preferred structures of the microphone arrangement according to the first aspect of the disclosure are shown and discussed below for FIGS. 2 and 3.

FIG. 2 illustrates a second embodiment of the microphone arrangement 100' according to the first aspect of the disclosure.

In this second embodiment, two microphones 210, 220 of the third group of microphones 116 are arranged symmetrically with respect to a user's head when the microphone arrangement 100' is head-worn and provide for a directionality that is orientated to the direction of a user's vision. As in FIG. 1, the user's vision is directed out of the drawing plane.

The second microphone 220 of the third group of microphones is electrically connected to the signal transmission circuitry provided in the casing 130 via a connection within a headband 230 of the headset 150, which connects the ear pad 140 with a second ear pad 240.

All further features of the microphone arrangement 100' according to the second embodiment are identical to those of the first embodiment shown in FIG. 1. In particular, the arrangement of the first group and of the second group of microphones 112, 114 is identical to the arrangement of the first embodiment.

In embodiments not shown, a plurality of microphones of the third group of microphones is provided at the ear pad 140 and at the second ear pad 240, respectively.

FIG. 3 illustrates a third embodiment of the microphone arrangement 100" according to the first aspect of the disclosure.

The microphone arrangement 100" according to the third embodiment combines the features of the first embodiment and of the second embodiment of the microphone arrangement 100, 100'. This means that the third group of microphones 116 comprises an anti-beamforming sub-group 310 comprising a microphone 315 that is directed away from the mouth of the user, and a beamforming sub-group 320 comprising a second and a third microphone 324, 328, which are arranged symmetrically with respect to the user's head and directed away from the mouth of the user.

Signals received by the second and third microphones 324, 328 serve to support the directionality of the processed sound signals provided by the first and second group of microphones 112, 114. Preferably, signals received by the beamforming sub-group 320 are processed together those received by the first and second group of microphones 112, 114.

Signals received by the microphone 315 of the anti-beamforming sub-group 310 are used for noise filtering the signals of the beamforming sub-group 320 and of the first and second group 112, 114, or for noise filtering a processed signal based on the signals of the beamforming sub-group 320 and of the first and second group 112, 114. The noise filtering is provided by subtracting the signal received by the microphone 315 of the anti-beamforming sub-group from the signals received by the other microphones of the microphone arrangement 100, which are directed to the user's mouth and therefore mainly comprise speech.

In the shown third embodiment, the microphone 315 of the anti-beamforming sub-group 310 is processed by a different processing unit than the microphones 324, 328 of the beamforming sub-group 320 (the processing units are not shown in this figure).

Figure 4:
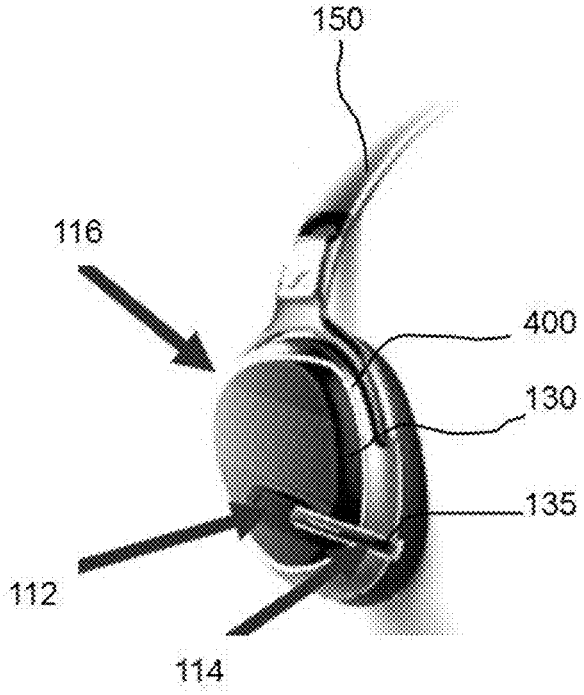
FIG. 4 illustrates an embodiment of an ear pad with a further embodiment of the microphone arrangement according to the first aspect of the disclosure.

FIG. 4 illustrates an embodiment of an ear pad 400 with a further embodiment of the microphone arrangement 100 according to the first aspect of the disclosure.

The illustrated ear pad forms a part of a headset 150 that has a microphone arrangement 100 similar to the first embodiment shown in FIG. 1. In particular, the third group of microphones 116 is arranged in a position that is spaced apart from the user's mouth compared to the microphones of the first and second group 112, 114. The microphones are directed away from the user's mouth for receiving a noise signal of the environment of the user of the headset 150.

Furthermore, the microphones of the first group 112 are attached to the casing 130, i.e. to the ear pad 400, while the second group of microphones 114 is attached to the microphone boom 135, which can be slid with respect to the casing 130.

The signal transmission circuitry of the microphone arrangement 100 is completely provided within the illustrated ear pad 400.

FIG. 5 illustrates an embodiment of a microphone boom 500 according to a third aspect of the disclosure.

The microphone boom 500 comprises an U-shaped slider 510 with two legs 512, 514 and an interconnection 516 that connects the two legs 512, 514. The slider further has second openings 524 for passing sound signals to the second group of microphones 114, while a boom casing 530 has first openings 522 for passing sound signals to the first group of microphones 112.

The boom casing 530 comprises rails 532 on which the slider 510 can be slid between a closed position of the microphone boom 500 (first and second group of microphones 112, 114 in close proximity) and an opened position (first and second group of microphones 112, 114 spaced apart from each other). Furthermore, the boom casing 530 comprises a connection section 538 via which the boom casing 530 and a respective circuitry of the boom casing 530 can be rotatably attached to the casing 130 of the head-wearable support structure 120 and thereby electrically connected to the signal transmission circuitry of the microphone arrangement 100. The rotatably attachment of the boom casing via the connection section 538 advantageously allows an individual adjustment of the microphone boom 500 to the mouth of the user.

In an embodiment not shown, the third group of microphones is provided at a backside of the microphone boom, thereby being directed away from the mouth of the use when the microphone arrangement is head-worn.

Figure 6:
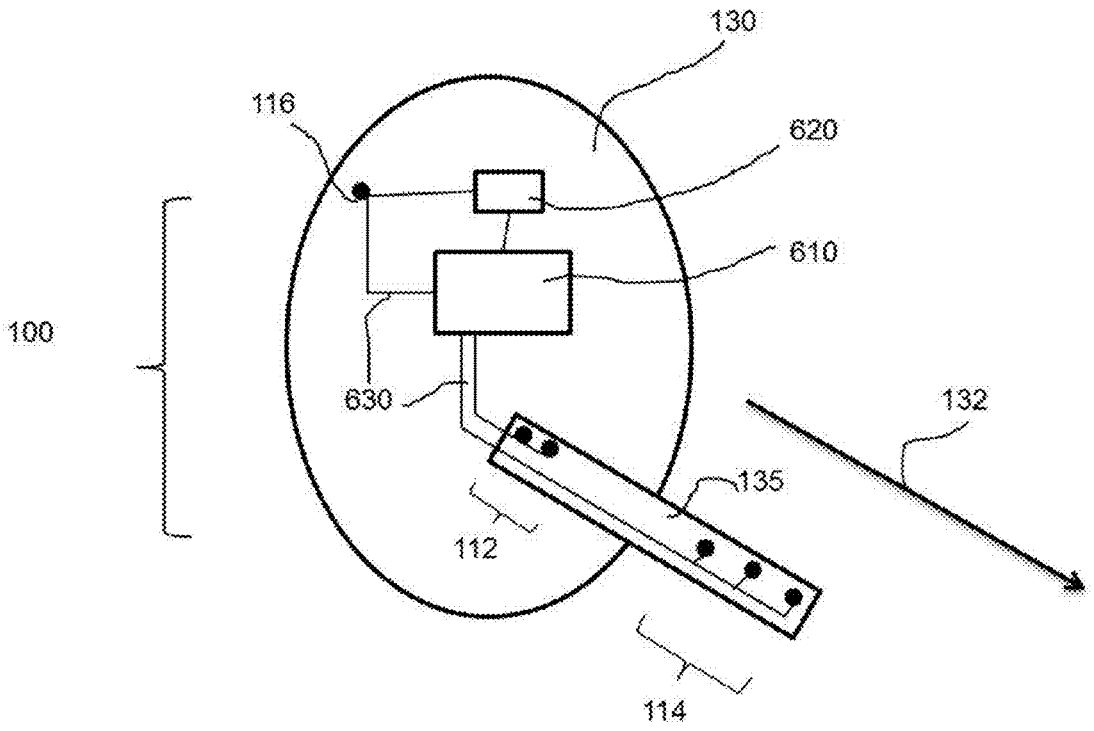
FIG. 6 illustrates an embodiment of a microphone arrangement system according to a second aspect of the disclosure.

FIG. 6 illustrates an embodiment of a microphone arrangement system 600 according to a second aspect of the disclosure.

The microphone arrangement system 600 comprises an embodiment of the microphone arrangement 100, a processing unit 610 and a noise estimator 620.

The microphone arrangement system 100 comprises a first group of microphones 112 with two microphones that are attached to a fixed part of the microphone boom 135 and in a direction of the first axis 132. The further second group 114 of the microphone arrangement 100 comprises three microphones, which are attached to a slideable part (not shown) of the microphone boom 135. The third group 116 comprises a single microphone that is attached to the casing 130 such that it has a larger distance to a user's mouth than the microphones of the first and second group of microphones 112, 114, if the microphone arrangement 100 is head-worn.

Upon reception of a respective sound signal, the microphones of the microphone arrangement 100 are configured to provide a respective signal to the processing unit 620 via the signal transmission circuitry 630. Thereby, the processing unit 610 is configured to filter the sound signals (indicative of speech of the user) provided by the microphones of the first and second group of microphones 112, 114 with respect to the noise signal (i.e. the sound signal indicative of an environmental noise) received by the third group of microphones 116. In the illustrated preferred embodiment, the sound signals received by the first and second group of microphones 112, 114 are filtered by a noise filter within the processing unit 610 such that at least one processing step is formed by a subtracting of the noise signal received by the third group of microphones 116 from the signals of the first and second group 112, 114.

The noise estimator 620 is connected to the third group of microphones 116 by means of the signal transmission circuitry 630. The noise estimator 620 of this embodiment is configured to estimate a noise level of the sound signal received by the third microphone group 116, indicative of an environment of the microphone arrangement system 600, and to control the noise filter with respect to the estimated noise level.

In an embodiment not shown, the noise estimator is alternatively or additionally configured to estimate a noise spectrum of the signal provided by the third group of microphones and to control the noise filter with respect to the estimated noise spectrum.

In the illustrated embodiment shown in FIG. 6, the noise filter is controlled by the noise estimator 620 in such a way that the noise filter is deactivated if the estimated noise level is below a predefined threshold and that the noise filter is activated, if the estimated noise level is above the predefined threshold.

In a further embodiment not shown, the processing unit is further configured to process a signal according to a sliding position of the microphone boom, i.e. according to a position of the second group of microphones relative to the first group of microphones. In a preferred variant of this embodiment, the processing unit is deactivated or configured not to process a signal, if the sliding position of the second group is a closed position of the microphone boom.

It is intended that the structural features of the devices described above, either in the detailed description and/or in the claims, may be combined with steps of the method, when appropriately substituted by a corresponding process.

As used, the singular forms "a", "an", and "the" are intended to include the plural forms as well (i.e. to have the meaning "at least one"), unless expressly stated otherwise. It will be further understood that the terms "includes", "comprises", "including", and/or "comprising", when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more". Unless specifically stated otherwise, the term "some" refers to one or more.

REFERENCE NUMBER LIST

100, 100', 100" Microphone arrangement
112 First group of microphones
114 Second group of microphones
116 Third group of microphones
120 Head-wearable support structure
130 Casing
132 First axis
135 Microphone boom
140 Ear pad
150 Headset
210 First microphone
220 Second microphone
230 Headband
240 Second ear pad
310 Anti-beamforming sub-group
315 Microphone of the anti-beamforming sub-group
320 Beamforming sub-group
324 Second microphone of the beamforming-subgroup
328 Third microphone of the beamforming sub-group
400 Illustrated ear pad
500 Illustrated microphone boom
510 U-shaped slider
512, 514 Two legs of the U-shaped slider
516 Interconnection
522 First opening
524 Second opening
530 Boom casing
532 Rails
538 Connection section
600 Microphone arrangement system
610 Processing unit
620 Noise estimator
630 Signal transmission circuitry

The invention claimed is:

1. A microphone arrangement comprising at least three groups of microphones that are mounted on a head-wearable support structure including first and second earpads to be respectively worn next to first and second ears of a user, the at least three groups of microphones comprising a first group of microphones with one or more microphones, a second group of microphones with one or more microphones, and a third group of microphones with one or more microphones, wherein the first group is mounted to a first casing that accommodates signal transmission circuitry, the first casing being formed as part of the first earpad, the second group is mounted to slide with respect to the first casing, and the third group comprises a first microphone mounted on the first casing, a second microphone mounted on a second casing, the second casing being formed as part of the second earpad, wherein the first and second microphones are arranged symmetrically with respect to a user's head when the microphone arrangement is head-worn, and provide for a directionality that is orientated to the direction of a user's vision.

2. The microphone arrangement according to claim 1, wherein the first and/or the second group of microphones comprises at least two microphones that are arranged along a first axis or along an axis running parallel to said first axis.

3. The microphone arrangement according to claim 1, wherein the first group of microphones is mounted in a direction of a first axis and the third group of microphones comprises at least two microphones that are arranged along a second axis, which is different from the first axis.

4. The microphone arrangement according to claim 1, wherein the first group of microphones are attached to the first ear pad.

5. The microphone arrangement according to claim 1, wherein the third group of microphones is arranged such that, upon use of the microphone arrangement by a user, a distance between each of the first and second microphones and the mouth of the user of the microphone arrangement is larger than a distance between a microphone of the first or second group of microphones and the mouth of the user.

6. The microphone arrangement according to claim 1, wherein the second group of microphones is mounted on a slider that is arranged to slide on a corresponding rail of the slider between a closed position and an opened position, wherein the rail is arranged on the first casing.

7. The microphone arrangement according to claim 6, wherein the first group and the second group of microphones define a combined directional array of microphones when the slider is in the opened position.

8. The microphone arrangement according to claim 1, wherein the first group, the second and the third group are connected to the signal transmission circuitry.

9. The microphone arrangement according to claim 1, wherein the third group and/or the first group of microphones is arranged and configured to be formed by a bone conductor or by a necklace microphone array.

10. The microphone arrangement according to claim 1, wherein the third group includes a third microphone provided in a headband or in a neckband of the microphone arrangement.

11. A microphone arrangement system, comprising a microphone arrangement according to claim 1, and a processing unit which is arranged to be connected to the signal transmission circuitry and configured to process sound signals received by the first and second group with a noise filter that is adapted with respect to a noise signal received by the third group of microphones.

12. The microphone arrangement system according to claim 11, further comprising a noise estimator connected to the signal transmission circuitry, wherein the noise estimator is configured to estimate a noise level of an environment of the microphone arrangement system and to control the noise filter with respect to the estimated noise level.

13. The microphone arrangement system according to claim 11, wherein the processing unit is configured to process a signal according to a sliding position of the second group of microphones with respect to the first group.

14. A microphone boom, which is arranged and configured for being used in a microphone arrangement according to claim 1.

15. A headset, comprising a microphone arrangement system according to claim 11.

16. A microphone boom, which is arranged and configured for being used in a microphone arrangement system according to claim 11.

17. A headset, comprising a microphone boom according to claim 14.

18. The microphone arrangement according to claim 2, wherein the third group of microphones comprises at least two microphones that are arranged along a second axis, which is different from the first axis.

* * * * *